United States Patent [19]

Krogsrud

[11] 4,443,879

[45] Apr. 17, 1984

[54] ELECTROTHERMICAL FURNACE

[75] Inventor: Harald Krogsrud, Gjettum, Norway

[73] Assignee: Elkem a/s, Oslo, Norway

[21] Appl. No.: 496,334

[22] Filed: May 23, 1983

Related U.S. Application Data

[63] Continuation of Ser. No. 232,427, Feb. 9, 1981, abandoned.

[30] Foreign Application Priority Data

Feb. 21, 1980 [NO] Norway ..... 800466

[51] Int. Cl.[3] ..... F27D 1/04

[52] U.S. Cl. ..... 373/71; 373/73; 373/75; 373/85; 432/238

[58] Field of Search ..... 373/71, 73, 75, 85, 373/86, 87, 155, 76; 266/280, 281, 286; 432/238

[56] References Cited

U.S. PATENT DOCUMENTS

| | | | |
|---|---|---|---|
| 3,328,014 | 6/1967 | Logenecker | 432/238 |
| 3,975,575 | 8/1976 | Krogsrud | 373/86 |
| 4,005,252 | 1/1977 | Krogsrud | 373/86 |
| 4,199,652 | 4/1980 | Logenecker | 373/76 |

FOREIGN PATENT DOCUMENTS

| | | |
|---|---|---|
| 326245 | 3/1930 | United Kingdom . |
| 600630 | 4/1948 | United Kingdom . |
| 1064603 | 4/1967 | United Kingdom . |
| 1559691 | 1/1980 | United Kingdom . |

*Primary Examiner*—Roy N. Envall, Jr.

*Attorney, Agent, or Firm*—Eyre, Mann, Lucas & Just

[57] ABSTRACT

The present invention relates to a reduction furnace with a split furnace body, particularly suited for production of ferro alloys, pig iron or calcium carbide. Furnaces of such types are provided with a furnace pot equipped with an internal refractory lining anchored to the furnace wall by means of anchoring elements. According to the present invention the refractory lining of at least the upper section of the split furnace body comprises a plurality of individual, pre-fabricated elements which are removably arranged at least on the upper section. Each unit comprises preferably a rear plate of steel, pig iron or similar material and one or more anchoring ribs or bolts extending horizontally out from and rigidly secured to the rear plate. The anchoring ribs provide a hold for the refractory lining on the rear plate. The separate units are suspended at least from the upper segment by means of simple support means.

6 Claims, 4 Drawing Figures

ELECTROTHERMICAL FURNACE

This is a continuation of application Ser. No. 232,427, filed Feb. 9, 1981, now abandoned.

The present invention relates to electric smelting furnaces and more particularly, but not exclusively to a divided pot which is suitable for the production of ferro alloys, pig iron or calcium carbide. The interior of the pot of such furnaces is commonly equipped with a refractory lining supported by the segmented pot by means of anchoring elements cast into the refractory lining.

Furnaces having a split furnace body have commonly a pot divided into upper and lower sections rotatable with respect to each other both with regard to angular velocity and direction. Usually the two sections are allowed to rotate uni-directional the upper section rotating with a higher angular velocity than the lower section. Such feature will cause a movement of the charge in the smelting furnace, providing the required porosity of the charge. This will also help in reduction of formation of crusts and hangings in the furnace pot.

It has been proposed to give the upper section of a split furnace body the form of a truncated cone with a larger upper diameter and a smaller lower diameter. The tapering of the cone with respect to the vertical is usually in the order of 10°–15°. The upper, conical section comprises an external, peripherally arranged steel plate of thickness 25–30 mm provided with external ribs as reinforcing elements. The conical section is at its upper end terminated by a comparatively wide, horizontally arranged flange or collar section which extends radially outwards from the conical steel plate. Internally the two sections are provided with a refractory lining of mortar, the mortar being anchored to the steel plate(s) by means of anchoring bolts, ribs etc.

The introduction of a split furnace body has resulted in a different pattern of distribution of the charge material down through the furnace pot compared with the conventional furnace pots. In a split furnace body the charge has a substantial vertical velocity at the periphery of the furnace pot. Due to the ability of the split furnace body to break up the charge, keeping it porous and thereby providing increased flow of hot reaction gases at the periphery of the furnace pot, large heat stresses appear in the refractory lining compared with the stresses experienced with the conventional furnace. Such increased heat stresses cause increased wear on the refractory lining, especially in the upper section of the furnace body. It should be appreciated that increased wear also is experienced in the lower section, especially in the upper part of the lower section.

Replacement and maintenance of the refractory lining in a split furnace causes long break down of service and constitute comprehensive and expensive works.

The object of the present invention is to provide a refractory lining arrangement which reduces the down time due to repair and maintenance. According to the present invention the object is achieved by forming the refractory lining of a plurality of separate, pre-cast or pre-assembled elements which are removably arranged at least on the upper section of the split furnace body. Each refractory lining unit comprises preferably a rear plate of steel, cast iron or similar type of material. Each unit comprises further anchoring ribs or iron welded to the rear plate and extending outwardly from the plate.

The anchoring ribs or irons constitute the bond of the refractory lining to the rear plate.

According to one embodiment the rear plate is provided with one or more means such as hooks which, when the unit is mounted on the furnace wall(s) cooperate with corresponding means on the furnace wall(s) in order to stably support each unit in position on the pot wall. Said corresponding means may for example be holes, recesses etc.

The corresponding holes, recesses, etc. are preferably arranged on a horizontal flange extending radially outwards from the upper section of the furnace pot. The dimensions of each unit of refractory lining are preferably adjusted to the furnace diameter and the circumference. In order to compensate for any lateral expansion of each unit, the units have a lateral dimension which enable them to be supported by the furnace wall without exerting substantial lateral load on the neighbouring elements.

The various elements may have varying horizontal, radial length enabling the elements to project to varying degree into the furnace. As an example it may be practical to let groups of two to four contiguous elements extend into the furnace beyond their neighbouring elements, the groups being preferably more or less evenly distributed along the circumference of the furnace pot.

According to the present invention also the upper part of the lower section of a split furnace body may be equipped by a refractory lining made up of separate, pre-cast or pre-built refractory lining units. Such units are preferably arranged on the upper $\frac{1}{3}$ of the distance between the top of the lower section and the smelting area of the furnace.

According to the present invention a solution is provided where the down time due to maintenance of the refractory lining is reduced to a minimum when compared with a similar sized furnace with a conventionally arranged refractory lining.

These and other features of the present invention may be more fully understood when described in conjunction with the accompanying drawings showing one preferred embodiment of the present invention.

Figure 1:
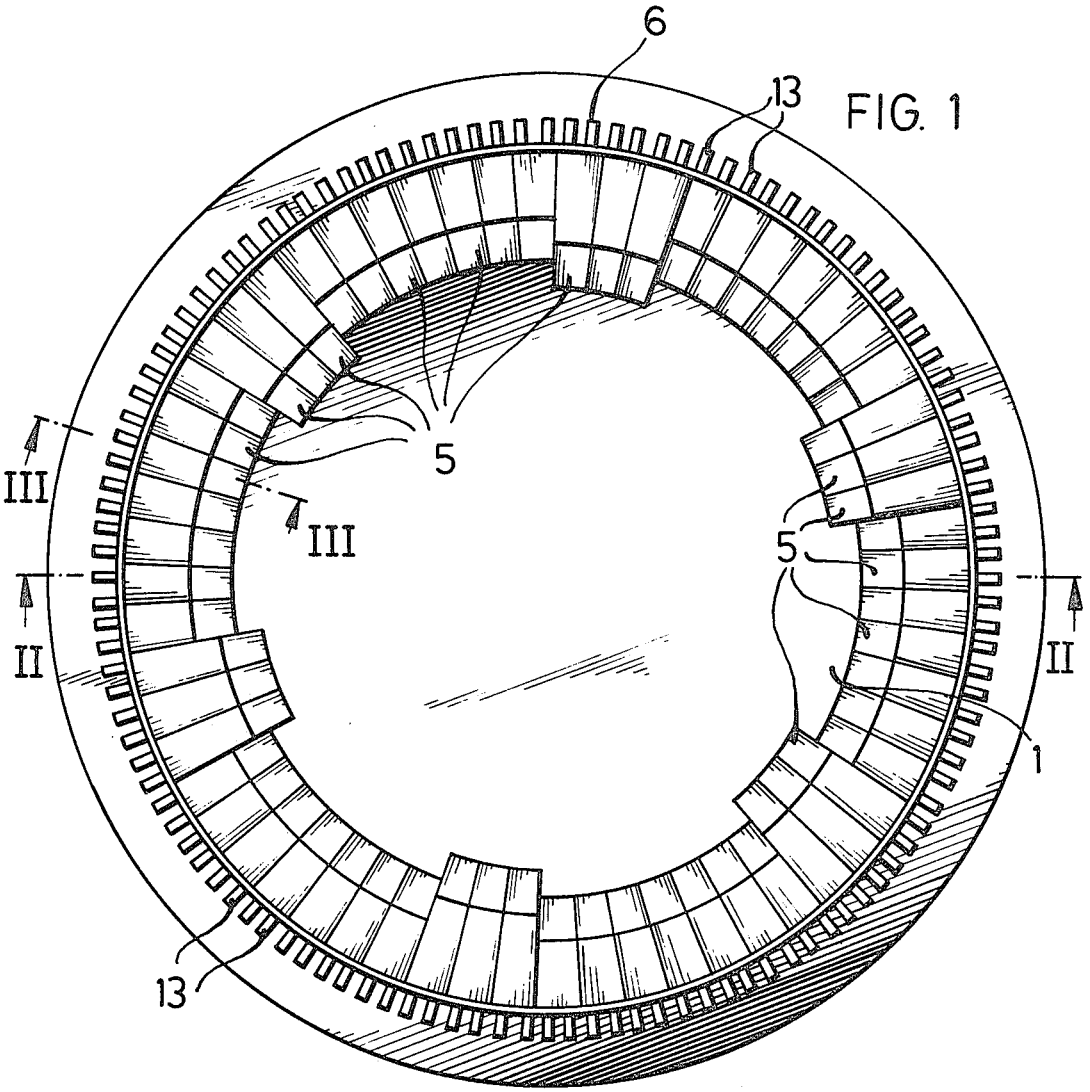
FIG. 1 shows a top view of a split furnace body incorporating removable refractory lining elements according to the present invention.
Figure 2:
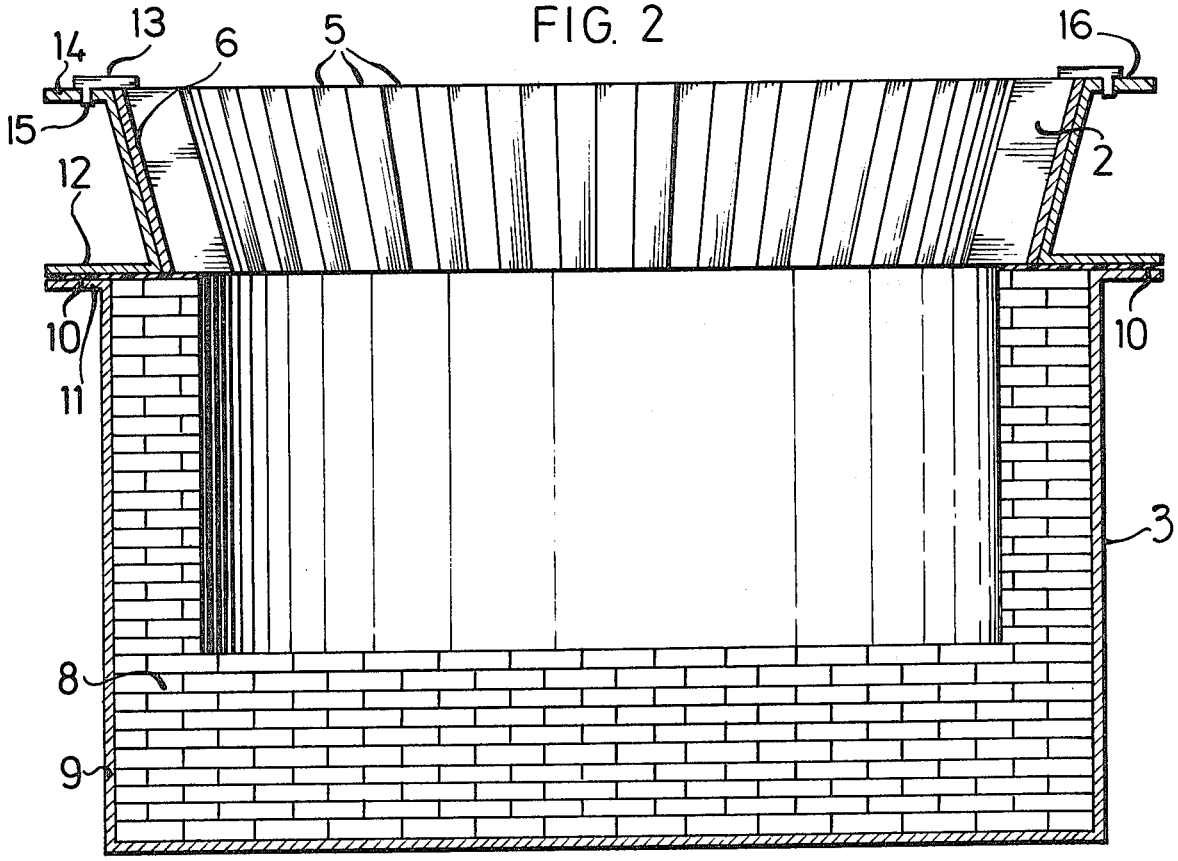
FIG. 2 shows a vertical section through the split furnace body, seen along the line II—II on FIG. 1.

FIG. 1 shows a horizontal view of the pot of the split furnace body 1 according to the present invention. The furnace pot 1 is divided into two horizontal parts, namely an upper section 2 and a lower section 3. The two sections 2, 3 may be individually rotated around a vertical axis, either unidirectional or in opposite direction. The upper section 2 is equipped with a refractory lining which is formed of a plurality of separate elements or units 5, each of which being removably arranged on the upper section 2. As shown on FIG. 3 each element or unit 5 comprises a rear plate 6 of steel, cast iron or similar type of material. Each element 5 is further equipped with one or more anchoring bolts, ribs or the like 7, extending outwardly from the rear plate 6 in a direction which corresponds to the direction of the centre of the furnace when the elements 5 are installed.

The anchoring means 7 provide hold for the refractory lining 4 on the rear plate 6.

The upper section 2 is at its upper and lower end provided with a horizontal, radially extending flange or plate 12, 14, extending outwardly from the furnace.

Also the lower section 3 of the split furnace body is provided with a refractory lining 8. On the embodiment shown on the Figures, the lower refractory lining 3 comprises an internally arranged refractory brick masonary. At its upper end the lower section 3 is equipped with a horizontal flange 11, projecting outwardly in a lateral direction from the furnace pot. The upper section 2 is rotatably arranged on the horizontal flange 11, the lower flange 12 of the upper section 2 being rotatably arranged on the flange 11 of the lower segment 3, rotating on the surface 10.

As shown on FIG. 1 the removably arranged lining elements 5 may have varying dimensions in radial direction thereby extending to a larger or lesser extent into the furnace. In all cases shown, however, the units 5 have a greater radial dimension at the top than at the bottom. This tapering of the units 5 facilitates easy removal of individual units. Groups of two or four contiguous units may for example extend into the furnace beyond their neighbouring units 5, the groups being preferably evenly distributed along the circumference of the furnace body 1.

Figure 3:
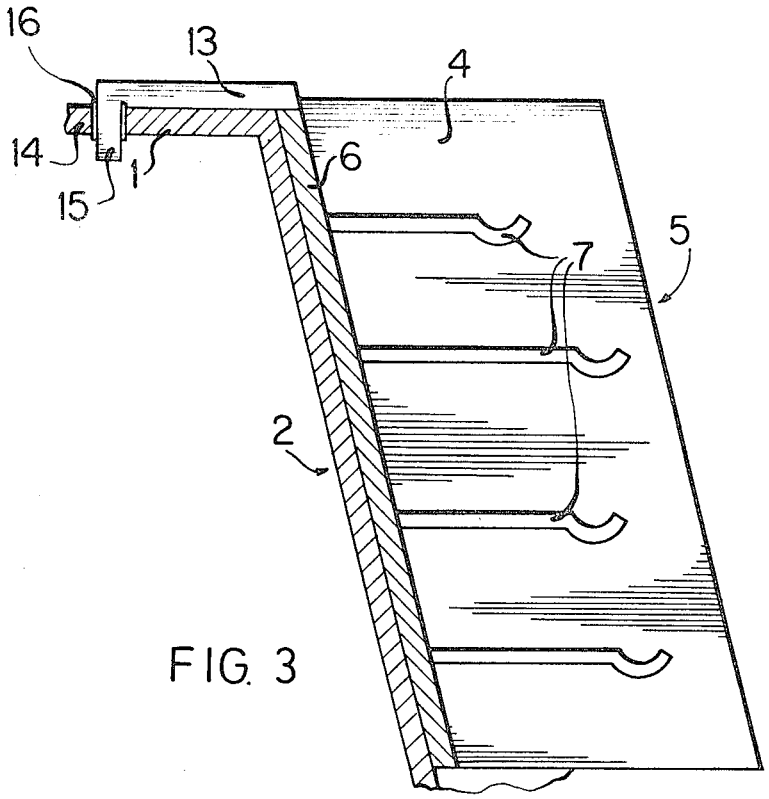
FIG. 3 shows a vertical section through the upper segmented section of the split furnace, seen along line III—III on FIGS. 1 in enlarged scale
Figure 4:
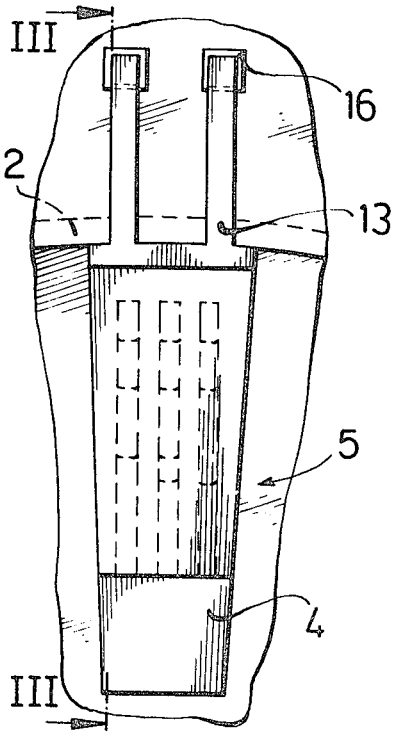
FIG. 4 shows a horizontal view of an element according to the present invention.

A replaceable unit 5 and a preferred method of arranging such unit will now be described in conjunction with FIGS. 3 and 4.

As previously described each unit 5 comprises a rear plate 6 of steel or similar material. Each unit 5 is tapered to be narrower at the bottom than at the top. This facilitates easy removal of the units from the furnace so that they can be readily replaced. One or more bolts, ribs, etc. 7 of steel, cast iron etc. extend outwardly from the rear plate 6 in such direction that these, when a unit 5 is installed in its position, extend radially inwards towards the centre of the furnace. The anchoring bolts 7 provide hold for the refractory lining unit on the rear plate 6.

At its upper end each unit is provided with one or more means 13 for securing each unit to the upper section 2, the securing means 13 being intended to cooperate with corresponding means on the peripheral steel casing of the upper section 2. According to the embodiment shown in FIG. 3 each securing means 13 comprises two horizontally extending arms 13, projecting in the opposite direction of the anchoring irons 7. One end of each arm 13 is rigidly fixed to the rear plate 6 while the free end of the arms is provided with a downwardly projecting bend, bolt etc. 15, designed to engage with holes or recesses 16 arranged in the upper flange 14.

The lateral dimensions of each unit 5 are preferably adjusted with respect to the circumference of the furnace and with respect to lateral expansion of the unit due to heating, enabling each unit 5 to be suspended from the flange 14 without causing excessive lateral forces on the neighbouring element 5 in lateral direction.

According to the embodiment shown on the Figures only the upper section 2 of the split furnace body is equipped with pre-built units 6. It should be appreciated, however, that also the lower section 3 may be equipped with such pre-assembled, removable elements 6, if required or deemed desirable.

It should further be appreciated that the means 13 for securing the separate units 5 to the furnace is not limited to the embodiment shown on the drawings or described above, but may be varied in any suitable manner without deviating from the inventive idea. It should also be appreciated that the units 5 do not necessarily have to be suspended by means arranged at their upper ends.

Further, it should be appreciated that although the upper section 2 of the disclosed embodiment is in the form of a truncated hollow cone, having a larger upper diameter and a smaller lower diameter, the present invention is not limited to such a configuration, but may have any practical shape or form. Finally, it should be stressed that only parts of the furnace which is relevant and necessary for the understanding of the present invention is described.

I claim:

1. In an electric smelting furnace, a furnace pot divided into upper and lower sections with the said sections being rotatable with respect to each other, the upper furnace pot comprising:
   (a) a peripheral portion in the shape of a truncated cone with the wide portion of the truncated cone at the top thereof;
   (b) a circumferential flange extending radially outward from the top of the peripheral portion in a substantially horizontal direction;
   (c) a plurality of engaging means positioned about the top of the circumferential flange;
   (d) a plurality of refractory lining plates covering the interior of said peripheral portion, each said lining plate being tapered to facilitate easy removal and having a radial dimension at its top greater than the radial dimension at its bottom, each said lining plate covering a radial portion of the interior of said peripheral portion from the top to the bottom of the peripheral portion and each said lining plate comprising a backing plate with a refractory material rigidly secured on the face thereof;
   (e) at least some of said lining plates having an engaging flange extending radially outward from the top of the backing plate in substantially the same direction as the said circumferential flange; each said engaging flange having engaging means positioned on the bottom of the engaging flange; and
   (f) the engaging means of the engaging flange engaging the engaging means of the circumferential flange in easily removable relationship.

2. The electric smelting furnace of claim 1 wherein each said lining plate has an engaging flange and an engaging means engaging the engaging means of the circumferential flange.

3. The electric smelting furnace of claim 13 wherein some of the lining plates have a greater distance in radial direction than others whereby the said some of the lining plates extend further into the furnace pot than other of the lining plates.

4. The electric smelting furnace of claim 3 wherein there are a plurality of groups of said some of the lining plates spaced about the peripheral portion of the upper furnace pot.

5. In an electric smelting furnace, a furnace pot divided into upper and lower sections with the said sections being rotatable with respect to each other, the upper furnace pot comprising:
   (a) a peripheral portion in the shape of a truncated cone with the wide portion of the truncated cone at the top thereof;
   (b) a plurality of removable refractory lining plates covering the interior of said peripheral portion, each said lining plate being tapered to facilitate each removal and having a radial dimension at its top greater than the radial dimension at its bottom, each said plate covering a radial portion of the interior of said peripheral portion from the top to the bottom of the peripheral portion and each said lining plate comprising a backing plate with a refractory material on the face thereof; and (c) wherein some of the lining plates have a greater distance in radial direction than others whereby the said some of the lining plates will extend further into the furnace pot than other of the lining plates.

6. The electric smelting furnace of claim 5 wherein there are a plurality of groups of said some of the lining plates spaced about the peripheral portion of the upper furnace pot.

* * * * *